US010878760B2

(12) United States Patent
Kim et al.

(10) Patent No.: US 10,878,760 B2
(45) Date of Patent: Dec. 29, 2020

(54) DISPLAY DEVICE HAVING A VARIABLE PIXEL BLOCK BOUNDARY

(71) Applicant: SAMSUNG DISPLAY CO., LTD., Yongin-si (KR)

(72) Inventors: Sooyeon Kim, Namyangju-si (KR); Sun-Koo Kang, Seoul (KR); Boyeon Kim, Seoul (KR); Jae-Han Lee, Hwaseong-si (KR); Taegon Im, Gwangmyeong-si (KR); Moonshik Kang, Hwaseong-si (KR); Junghwan Cho, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 33 days.

(21) Appl. No.: 16/272,436

(22) Filed: Feb. 11, 2019

(65) Prior Publication Data

US 2019/0295474 A1 Sep. 26, 2019

(30) Foreign Application Priority Data

Mar. 20, 2018 (KR) ..... 10-2018-0031919

(51) Int. Cl.
*G09G 3/3291* (2016.01)
*G09G 3/36* (2006.01)

(52) U.S. Cl.
CPC ..... *G09G 3/3291* (2013.01); *G09G 3/3688* (2013.01); *G09G 2310/08* (2013.01); *G09G 2320/0223* (2013.01)

(58) Field of Classification Search
CPC ..... G09G 3/3291; G09G 3/3688; G09G 2320/0223; G09G 2310/08; G09G 3/3648; G09G 2310/0291; G09G 2310/0218; G09G 3/3685; G09G 3/3275
See application file for complete search history.

(56) References Cited

U.S. PATENT DOCUMENTS

2010/0188379 A1* 7/2010 Chen ..... G09G 3/20 345/208
2011/0007098 A1* 1/2011 Park ..... G09G 3/3611 345/690
2018/0374447 A1* 12/2018 Yun ..... G09G 3/00
2019/0156756 A1* 5/2019 Aizawa ..... G09G 3/3258

FOREIGN PATENT DOCUMENTS

JP 2015-203831 11/2015
KR 10-2010-0056201 5/2010
KR 10-2017-0128693 11/2017

* cited by examiner

*Primary Examiner* — Amit Chatly
(74) *Attorney, Agent, or Firm* — F. Chau & Associates, LLC

(57) ABSTRACT

A display device including: a display panel including a plurality of pixels; and a data driver configured to arrange the display panel into a plurality of pixel blocks, and to output a data voltage with different slew rates to the plurality of pixel blocks, wherein the slew rates are based on distances of the plurality of pixel blocks from the data driver, wherein a boundary between adjacent pixel blocks with different slew rates is changeable.

17 Claims, 9 Drawing Sheets

| BLOCK | PWRC |
|---|---|
| BL1 | HLL |
| BL2 | HLH |
| BL3 | HHL |
| BL4 | HHH |

DISPLAY DEVICE HAVING A VARIABLE PIXEL BLOCK BOUNDARY

CROSS-REFERENCE TO RELATED APPLICATION

This application claims priority under 35 U.S.C. § 119 to Korean Patent Application No. 10-2018-0031919, filed on Mar. 20, 2018 in the Korean Intellectual Property Office (KIPO), the disclosure of which is incorporated by reference herein in its entirety.

1. TECHNICAL FIELD

Exemplary embodiments of the inventive concept relate generally to display devices. More particularly, exemplary embodiments of the inventive concept relate to display devices having variable pixel block boundaries.

2. DESCRIPTION OF THE RELATED ART

A display device, e.g., a flat or curved panel display device, provides a data voltage to a pixel to display an image corresponding to the data voltage. The data voltage may be delayed by a resistor-capacitor (RC) delay depending on a distance from a data driver to the pixel. In other words, a transition time of the data voltage for a pixel that is far from the data driver may be longer than a transition time of the data voltage for a pixel that is close to the data driver. Accordingly, as the distance of a pixel from the data driver increases, the transition time of the data voltage increases, and thus, a charging rate of the pixel decreases, which results in deterioration of an image quality. For example, as a resolution of the display device increases, one horizontal time (1H) decreases, and thus, the deterioration of its image quality may escalate.

SUMMARY

According to exemplary embodiments of the inventive concept, there is provided a display device including a display panel including a plurality of pixels, and a data driver configured to arrange the display panel into a plurality of pixel blocks, and to output a data voltage with different slew rates to the plurality of pixel blocks, wherein the slew rates are based on distances of the plurality of pixel blocks from the data driver. A boundary between adjacent pixel blocks with the different slew rates is changeable.

In an exemplary embodiment of the inventive concept, the boundary between the adjacent pixel blocks may be periodically changed.

In an exemplary embodiment of the inventive concept, the boundary between the adjacent pixel blocks may be changed on a per-frame basis.

In an exemplary embodiment of the inventive concept, the boundary between the adjacent pixel blocks is changed, when the boundary between the adjacent pixel blocks is randomly set within a predetermined boundary range.

In an exemplary embodiment of the inventive concept, the boundary between the adjacent pixel blocks is changed, when the boundary between the adjacent pixel blocks is randomly set within a predetermined boundary range on the per-frame basis.

In an exemplary embodiment of the inventive concept, the plurality of pixel blocks may include a first pixel block and a second pixel block, wherein the first pixel block is closer to the data driver than the second pixel block. The data driver may output the data voltage with a first slew rate to the first pixel block, and may output the data voltage with a second slew rate higher than the first slew rate to the second pixel block.

In an exemplary embodiment of the inventive concept, the data driver may include a plurality of output buffers configured to output the data voltage to a plurality of data lines, and a bias generator configured to provide a bias current to the plurality of output buffers. The bias current may be changed such that the plurality of output buffers output the data voltage with different slew rates to the plurality of pixel blocks.

In an exemplary embodiment of the inventive concept, when the data voltage is output to a pixel block close to the data driver among the plurality of pixel blocks, the bias generator may provide a first bias current to the plurality of output buffers, and when the data voltage is output to a pixel block far from the data driver among the plurality of pixel blocks, the bias generator may provide a second bias current to the plurality of output buffers, wherein the first bias current is lower than the second bias current.

In an exemplary embodiment of the inventive concept, the data driver may further include a register configured to store a current setting value for setting a level of the bias current generated by the bias generator, and the register may store different current setting values for the plurality of pixel blocks.

In an exemplary embodiment of the inventive concept, the display device may further include a timing controller configured to control the data driver. The current setting value of the register may be set by the timing controller.

In an exemplary embodiment of the inventive concept, the display device may further include a timing controller configured to control the data driver, and to provide the data driver with a transfer pulse for controlling an output timing of the data voltage. The transfer pulse may have different pulse widths depending on distances of the plurality of pixels within each of the plurality of pixel blocks from the data driver.

In an exemplary embodiment of the inventive concept, as the distances of the plurality of pixels within each of the plurality of pixel blocks from the data driver increase, the pulse width of the transfer pulse may be increased.

According to an exemplary embodiment of the inventive concept, there is provided a display device including a display panel including a plurality of pixels, and a data driver configured to divide the display panel into a first pixel block and a second pixel block, wherein the first pixel block is closer to the data driver than the second pixel block, to output a data voltage with a first slew rate to the first pixel block, and to output the data voltage with a second slew rate higher than the first slew rate to the second pixel block. A boundary between the first pixel block and the second pixel block may be randomly set.

In an exemplary embodiment of the inventive concept, the boundary between the first pixel block and the second pixel block may be randomly set within a predetermined boundary range on a per-frame basis.

According to an exemplary embodiment of the inventive concept, there is provided a display device including a display panel including a plurality of pixels, a first data driver configured to output a data voltage to a first portion of the display panel, and a second data driver configured to output the data voltage to a second portion of the display panel. The first data driver divides the first portion of the display panel into a plurality of first pixel blocks, and outputs the data voltage with different slew rates to the plurality of first pixel blocks according to their distances from the first data driver. The second data driver divides the second portion of the display panel into a plurality of second pixel blocks, and outputs the data voltage with different slew rates to the plurality of second pixel blocks according to their distances from the second data driver. A boundary between the plurality of first pixel blocks and a boundary between the plurality of second pixel blocks are set independently of each other, and are changeable.

In an exemplary embodiment of the inventive concept, the boundary between the plurality of first pixel blocks and the boundary between the plurality of second pixel blocks may be periodically changed.

In an exemplary embodiment of the inventive concept, the boundary between the plurality of first pixel blocks and the boundary between the plurality of second pixel blocks may be changed on a per-frame basis.

In an exemplary embodiment of the inventive concept, the boundary between the plurality of first pixel blocks may be randomly set within a predetermined boundary range, and the boundary between the plurality of second pixel blocks may be randomly set within the predetermined boundary range.

In an exemplary embodiment of the inventive concept, the boundary between the plurality of first pixel blocks may be randomly set within a predetermined boundary range on a per-frame basis, and the boundary between the plurality of second pixel blocks may be randomly set within the predetermined boundary range on the per-frame basis.

In an exemplary embodiment of the inventive concept, the display device may further include a timing controller configured to control the first data driver and the second data driver, to provide a first transfer pulse to the first data driver, and to provide a second transfer pulse to the second data driver. A pulse width of the first transfer pulse may be increased as distances of the plurality of pixels within each of the plurality of first pixel blocks from the first data driver increase, and a pulse width of the second transfer pulse may be increased as distances of the plurality of pixels within each of the plurality of second pixel blocks from the second data driver increase.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
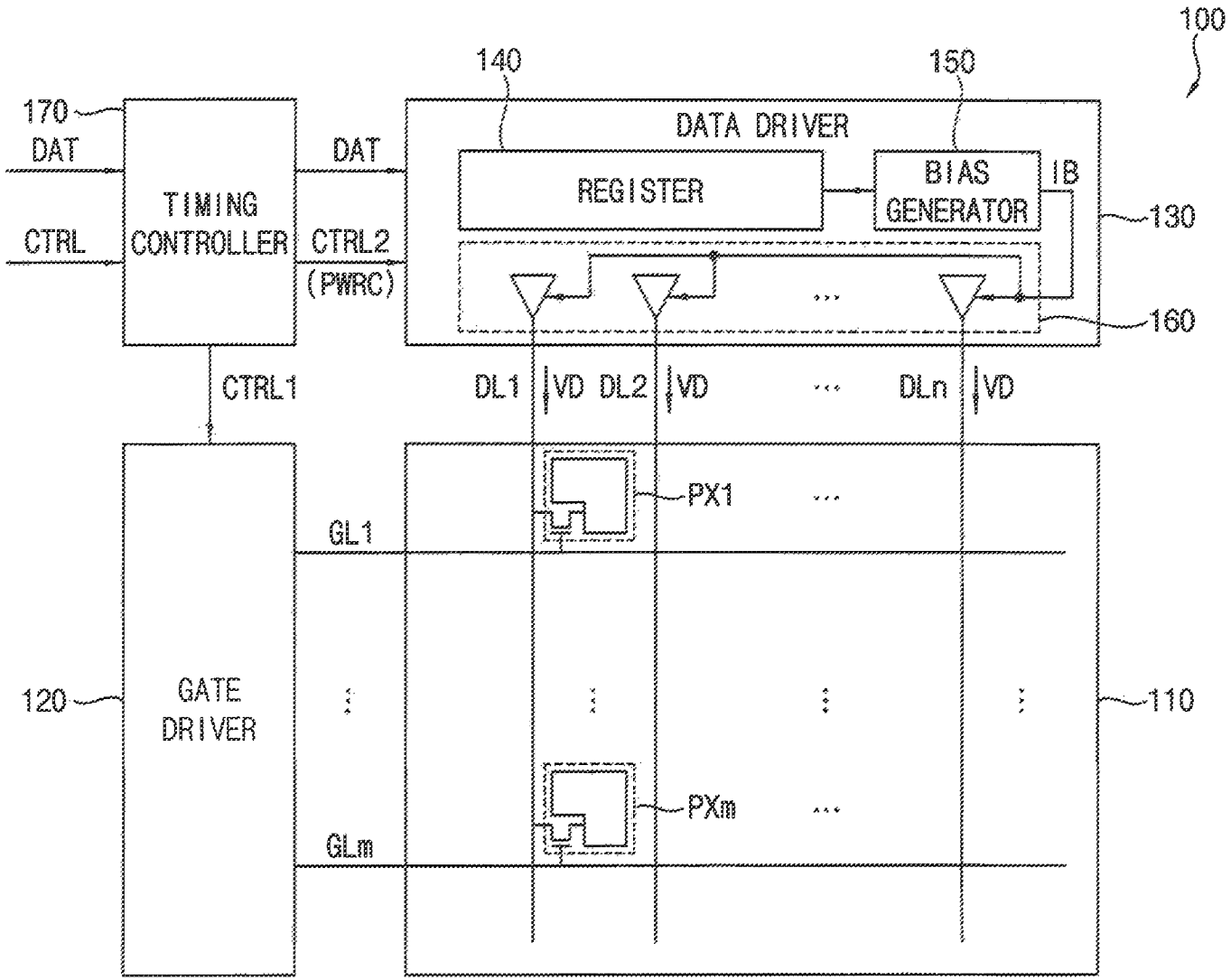
FIG. 1 is a block diagram illustrating a display device according to an exemplary embodiment of the inventive concept.

Exemplary embodiments of the inventive concept are described more fully hereinafter with reference to the accompanying drawings. Like or similar reference numerals may refer to like or similar elements throughout the specification and drawings.

Figure 2:
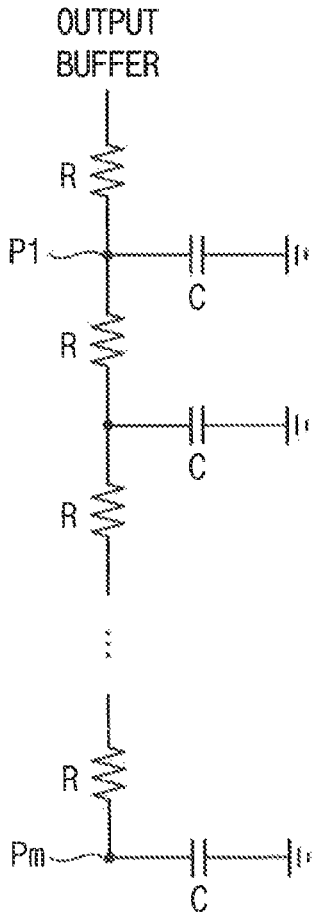
FIG. 2 is a diagram illustrating an equivalent model of one data line and a plurality of pixels connected to the data line, according to an exemplary embodiment of the inventive concept.
Figure 3A:
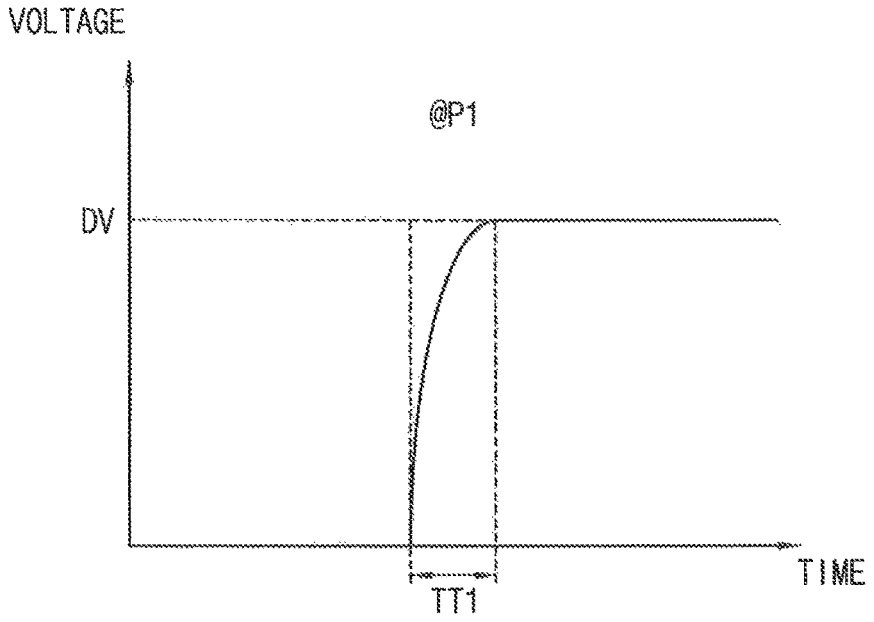
FIG. 3A is a graph illustrating a data voltage at a first position of the equivalent model of FIG. 2.
Figure 3B:
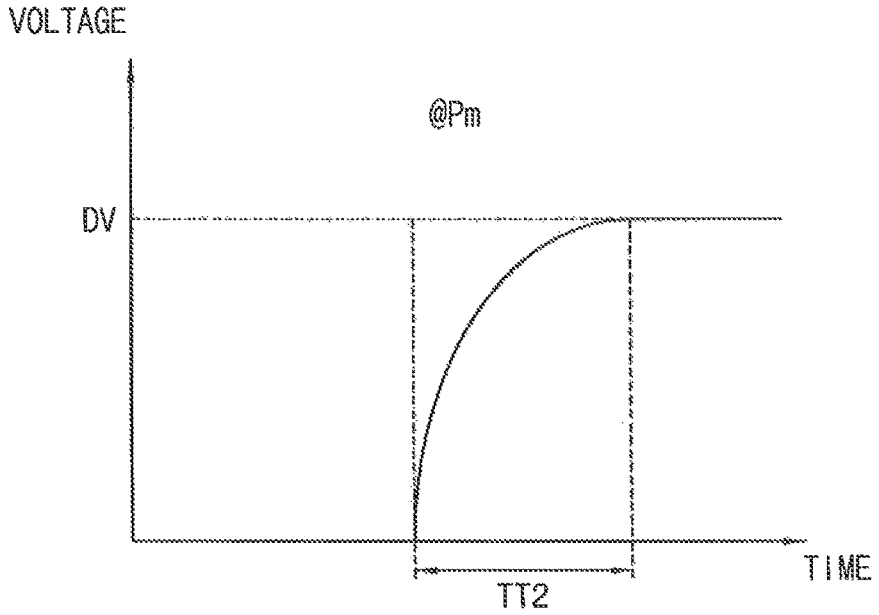
FIG. 3B is a graph illustrating a data voltage at an m-th position of the equivalent model of FIG. 2.
Figures 4, 5:
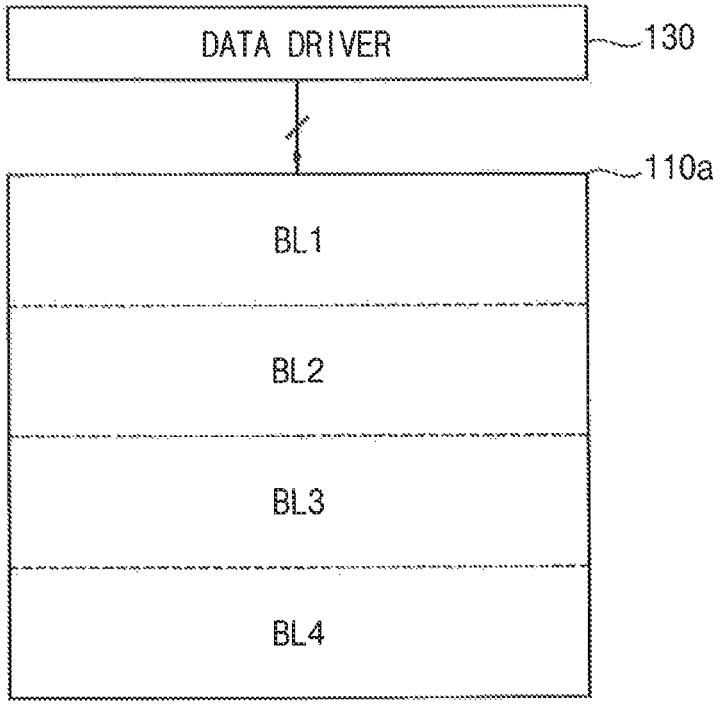
FIG. 4 is a diagram for describing a case where a display panel is divided into a plurality of pixel blocks in a display device according to an exemplary embodiment of the inventive concept.
FIG. 5 is a diagram for describing current setting values for a plurality of pixel blocks in a display device according to an exemplary embodiment of the inventive concept.
Figure 6:
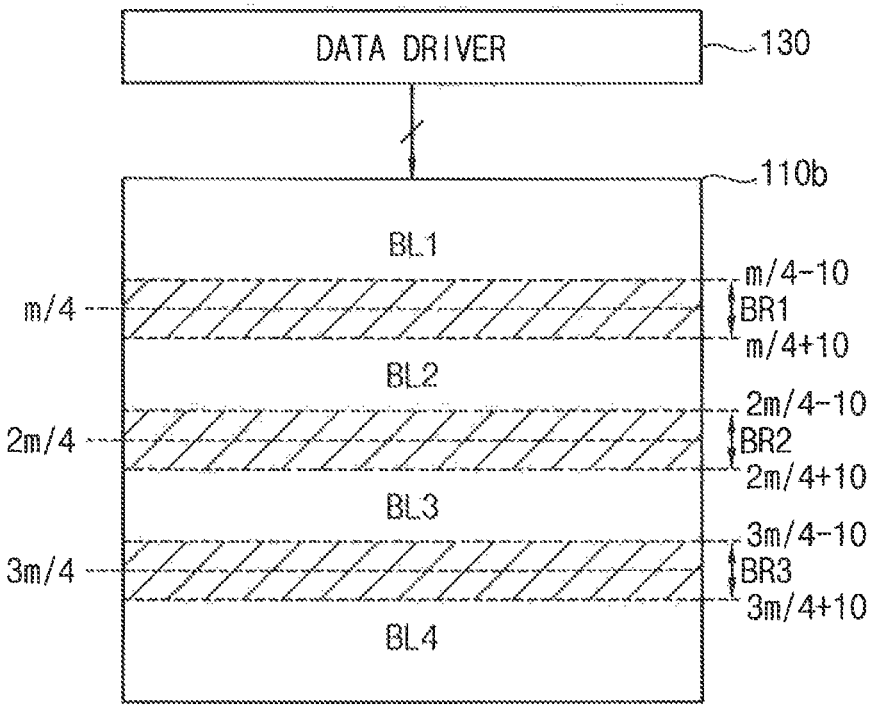
FIG. 6 is a diagram for describing a case where a boundary between a plurality of pixel blocks is randomly set in a display device according to an exemplary embodiment of the inventive concept.

FIG. 1 is a block diagram illustrating a display device according to an exemplary embodiment of the inventive concept, FIG. 2 is a diagram illustrating an equivalent model of one data line and a plurality of pixels connected to the data line, according to an exemplary embodiment of the inventive concept, FIG. 3A is a graph illustrating a data voltage at a first position of the equivalent model of FIG. 2, FIG. 3B is a graph illustrating a data voltage at an m-th position of the equivalent model of FIG. 2, FIG. 4 is a diagram for describing a case where a display panel is divided into a plurality of pixel blocks in a display device according to an exemplary embodiment of the inventive concept, FIG. 5 is a diagram for describing current setting values for a plurality of pixel blocks in a display device according to an exemplary embodiment of the inventive concept, and FIG. 6 is a diagram for describing a case where a boundary between a plurality of pixel blocks is randomly set in a display device according to an exemplary embodiment of the inventive concept.

Referring to FIG. 1, a display device 100 may include a display panel 110 which includes a plurality of pixels PX1 to PXm, a gate driver 120 which provides a gate signal to the plurality of pixels PX1 to PXm, a data driver 130 which provides a data voltage VD to the plurality of pixels PX1 to PXm, and a timing controller 170 which controls the gate driver 120 and the data driver 130.

The display panel 110 may include a plurality of gate lines GL1 to GLm, a plurality of data lines DL1, DL2 . . . DLn, and the plurality of pixels PX1 to PXm connected to the plurality of gate lines GL1 to GLm and the plurality of data lines DL1, DL2 . . . DLn. In an exemplary embodiment of the inventive concept, as illustrated in FIG. 1, each pixel PX1 to PXm may include a switching transistor, and a liquid crystal capacitor connected to the switching transistor. In this case, for example, the display panel 110 may be a liquid crystal display (LCD) panel. In another exemplary embodiment of the inventive concept, each pixel PX1 to PXm may include at least two transistors, at least one capacitor, and an organic light emitting diode (OLED). In this case, for example, the display panel 110 may be an OLED display panel. However, the display panel 110 may not be limited to the LCD panel and the OLED panel, and may be any of a variety of types of display panels.

The gate driver 120 may generate the gate signal based on a gate control signal CTRL1 provided from the timing controller 170, and may sequentially apply the gate signal to the plurality of gate lines GL1 to GLm. In an exemplary embodiment of the inventive concept, the gate control signal CTRL1 may include, but is not limited to, a gate clock signal, a scan start pulse, etc. According to an exemplary embodiment of the inventive concept, the gate driver 120 may be mounted directly on the display panel 110, may be connected to the display panel 110 in a form of a tape carrier package (TCP), and may be integrated in a peripheral portion of the display panel 110.

The data driver 130 may generate the data voltage VD based on output image data DAT and a data control signal CTRL2 provided from the timing controller 170. The data driver 130 may apply the data voltage VD to the plurality of data lines DL1, DL2 . . . DLn. In an exemplary embodiment of the inventive concept, the data control signal CTRL2 may include, but is not limited to, a horizontal start signal, a load signal, etc. For example, the data control signal CTRL2 may include a control signal (e.g., a power range current control signal) PWRC for setting a current setting value of a register included in the data driver 130, and/or a transfer pulse (TP) for controlling an output timing of the data voltage VD. According to an exemplary embodiment of the inventive concept, the data driver 130 may be mounted directly on the display panel 110, may be connected to the display panel 110 in the form the TCP, and may be integrated in the peripheral portion of the display panel 110.

The timing controller 170 may receive input image data DAT and a control signal CTRL from an external host (e.g., a graphic processing unit (GPU)). In an exemplary embodiment of the inventive concept, the input image data DAT may be RGB data including red image data, green image data and blue image data. In an exemplary embodiment of the inventive concept, the control signal CTRL may include, but is not limited to, a data enable signal, a master clock signal, etc. The timing controller 170 may generate the gate control signal CTRL1, the data control signal CTRL2 and the output image data DAT based on the control signal CTRL and the input image data DAT. In other words, the timing controller 170 may generate the gate control signal CTRL1, the data control signal CTRL2 and the output image data DAT in response to the control signal CTRL and the input image data DAT. The timing controller 170 may control an operation of the gate driver 120 by providing the gate control signal CTRL1 to the gate driver 120, and may control an operation of the data driver 130 by providing the data control signal CTRL2 and the output image data DAT to the data driver 130.

The data voltage VD output from the data driver 130 may be delayed depending on distances of the plurality of pixels PX1 to PXm from output buffers 160 of the data driver 130. For example, as illustrated in FIG. 2, the data line DL1 and the plurality of pixels PX1 . . . PXm connected to the data line DL1 may be represented as an equivalent model including resistors R connected in series and capacitors C connected to the resistors R. As can be seen, the data voltage VD may be delayed by a resistor-capacitor (RC) delay of the resistors R and the capacitors C depending on the distances of the plurality of pixels PX1 and PXm from the output buffer.

For example, in a case where the output buffers 160 of the data driver 130 output the data voltage VD with the same slew rate to the plurality of pixels PX1 to PXm, due to the RC delay, a transition time of the data voltage VD for an m-th pixel PXm that is relatively far from the data driver 130 may be longer than a transition time of the data voltage VD for a first pixel PX1 that is relatively close to the data driver 130. It is to be understood that a transition time of the data voltage VD may be a time during which the data voltage is changed to a desired level. For example, at a first position P1 (see FIG. 2) when the data voltage VD is applied to the first pixel PX1 that is relatively close to the data driver 130, the data voltage VD may have a relatively short first transition time TT1 as illustrated in FIG. 3A. However, at an m-th position Pm (see FIG. 2) when the data voltage VD is applied to the m-th pixel PXm that is relatively far from the data driver 130, the data voltage VD may have a second transition time TT2 longer than the first transition time TT1 as illustrated in FIG. 3B. Accordingly, since the transition time TT1 and TT2 of the data voltage VD increases as the distance of a pixel from the data driver 130 increases, a charging rate of the pixel PXm is decreased as the distance from the data driver 130 increases. In this case, image quality of the display device 100 deteriorates. For example, as a resolution of the display device 100 increases, one horizontal time (1H) decreases, and thus, the deterioration of its image quality may be increased.

However, in the display device 100 according to an exemplary embodiment of the inventive concept, the display panel 100 may be divided into a plurality of pixel blocks each including a plurality of pixel rows according to a distance from the data driver 130. Here, the data driver 130 may output the data voltage VD with different slew rates to the plurality of pixel blocks according to their distances from the data driver 130. For example, as illustrated in FIG. 4, a display panel 110*a* may be divided into a first pixel block BL1, a second pixel block BL2, a third pixel block BL3 and a fourth pixel block BL4 according to their distances from the data driver 130, and the data driver 130 may output the data voltage VD to the first through fourth pixel blocks BL1, BL2, BL3 and BL4 with a slew rate that increases as the distance from the data driver 130 increases.

In an exemplary embodiment of the inventive concept, to output the data voltage VD to the first through fourth pixel blocks BL1, BL2, BL3 and BL4 with the slew rate that increases as the distance from the data driver 130 increases, the data driver 130 may include a register 140, a bias generator 150 and the plurality of output buffers 160. The register 140 stores a current setting value, the bias generator 150 generates a bias current IB having a current level corresponding to the current setting value stored in the register 140, and the plurality of output buffers 160 output the data voltage VD based on the bias current IB generated by the bias generator 150. For example, when the data voltage VD is output to a pixel block (e.g., BL1) that is relatively close to the data driver 130 among the plurality of pixel blocks BL1, BL2, BL3 and BL4, the register 140 may store a relatively low current setting value, the bias generator 150 may provide a relatively low bias current IB to the plurality of output buffers 160 based on the relatively low current setting value, and the plurality of output buffers 160 may output the data voltage VD with a relatively low slew rate based on the relatively low bias current IB. Further, when the data voltage VD is output to a pixel block (e.g., BL4) that is relatively far from the data driver 130 among the plurality of pixel blocks BL1, BL2, BL3 and BL4, the register 140 may store a relatively high current setting value, the bias generator 150 may provide a relatively high bias current IB to the plurality of output buffers 160 based on the relatively high current setting value, and the plurality of output buffers 160 may output the data voltage VD with a relatively high slew rate based on the relatively high bias current IB.

In an exemplary embodiment of the inventive concept, the current setting value of the register 140 may be set by the control signal (e.g., the power range current control signal) PWRC from the timing controller 170. For example, the register 140 may store the current setting value having three bits. As illustrated in FIGS. 4 and 5, when the data voltage VD is output to a first pixel block BL1 closest to the data driver 130, the timing controller 170 may provide the data driver 130 with the control signal PWRC that sets the current setting value of the register 140 to a relatively low first setting value of 'HLL', the bias generator 150 may provide a bias current IB having a relatively low first current level corresponding to the first setting value to the plurality of output buffers 160, and the plurality of output buffers 160 may output the data voltage VD with a relatively low first slew rate corresponding to the first current level of the bias current IB to the first pixel block BL1. When the data voltage VD is output to a second pixel block BL2 farther from the data driver 130 than the first pixel block BL1, the timing controller 170 may provide the data driver 130 with the control signal PWRC that sets the current setting value of the register 140 to a second setting value of 'HLH' higher than the first setting value 'HLL', the bias generator 150 may provide the plurality of output buffers 160 with a bias current IB having a second current level higher than the first current level based on the second setting value, and the plurality of output buffers 160 may output the data voltage VD with a second slew rate higher than the first slew rate to the second pixel block BL2 based on the bias current IB having the second current level. When the data voltage VD is output to a third pixel block BL3 farther from the data driver 130 than the second pixel block BL2, the timing controller 170 may provide the data driver 130 with the control signal PWRC that sets the current setting value of the register 140 to a third setting value of 'HHL' higher than the second setting value 'HLH', the bias generator 150 may provide the plurality of output buffers 160 with a bias current IB having a third current level higher than the second current level based on the third setting value, and the plurality of output buffers 160 may output the data voltage VD with a third slew rate higher than the second slew rate to the third pixel block BL3 based on the bias current IB having the third current level. When the data voltage VD is output to a fourth pixel block BL4 farthest from the data driver 130, the timing controller 170 may provide the data driver 130 with the control signal PWRC that sets the current setting value of the register 140 to a fourth setting value of 'HHH' higher than the third setting value 'HHL', the bias generator 150 may provide the plurality of output buffers 160 with a bias current IB having a fourth current level higher than the third current level based on the fourth setting value, and the plurality of output buffers 160 may output the data voltage VD with a fourth slew rate higher than the third slew rate to the fourth pixel block BL4 based on the bias current IB having the fourth current level.

As described above, although the RC delay of the data voltage VD increases as the distance from the data driver 130 increases, the data voltage VD is output to the plurality of pixel blocks BL1, BL2, BL3 and BL4 with the slew rate that increases as the distance from the data driver 130 increases. Accordingly, transition times of the data voltage VD may be substantially uniform with respect to the plurality of pixel blocks BL1, BL2, BL3 and BL4, or with respect to the plurality of pixels PX1 to PXm, and charging rates of the plurality of pixels PX1 to PXm may be substantially uniform. For example, the transition time of the data voltage VD for the first pixel block BL1 may be substantially the same as the transition time of the data voltage VD for the fourth pixel block BL4. However, if at least one boundary between the plurality of pixel blocks BL1, BL2, BL3 and BL4 at which the slew rate is changed is fixed, a luminance difference at the boundary between the plurality of pixel blocks BL1, BL2, BL3 and BL4 may be perceived by a user.

However, in the display device 100 according to an exemplary embodiment of the inventive concept, the boundary between the plurality of pixel blocks BL1, BL2, BL3 and BL4 at which the slew rate is changed may be changed over time. In an exemplary embodiment of the inventive concept, the boundary between the plurality of pixel blocks BL1, BL2, BL3 and BL4 may be periodically changed. For example, the boundary between the plurality of pixel blocks BL1, BL2, BL3 and BL4 may be changed on a per-frame basis. Accordingly, the luminance difference at the boundary between the plurality of pixel blocks BL1, BL2, BL3 and BL4 may not be perceived by the user.

In exemplary embodiments of the inventive concept, to change the boundary between the plurality of pixel blocks BL1, BL2, BL3 and BL4, the boundary between the plurality of pixel blocks BL1, BL2, BL3 and BL4 may be randomly set within a predetermined boundary range (e.g., periodically or on the per-frame basis). For example, as illustrated in FIG. 6, in dividing a display panel 100*b* including m pixel rows respectively connected to m gate lines GL1 to GLm, where m is an integer greater than 1, a boundary between the first pixel block BL1 to which the data voltage VD is output with the first slew rate and the second pixel block BL2 to which the data voltage VD is output with the second slew rate higher than the first slew rate may be randomly set within a first boundary range BR1 from an (m/4−10)-th pixel row to an (m/4+10)-th pixel row, a boundary between the second pixel block BL2 to which the data voltage VD is output with the second slew rate and the third pixel block BL3 to which the data voltage VD is output with the third slew rate higher than the second slew rate may be randomly set within a second boundary range BR2 from a (2m/4−10)-th pixel row to a (2m/4+10)-th pixel row, and a boundary between the third pixel block BL3 to which the data voltage VD is output with the third slew rate and the fourth pixel block BL4 to which the data voltage VD is output with the fourth slew rate higher than the third slew rate may be randomly set within a third boundary range BR3 from a (3m/4−10)-th pixel row to a (3m/4+10)-th pixel row. As described above, since the boundaries between the plurality of pixel blocks BL1, BL2, BL3 and BL4 are randomly set within the boundary ranges BR1, BR2 and BR3 (e.g., periodically or on the per-frame basis), the luminance differences at the boundaries BR1, BR2 and BR3 between the plurality of pixel blocks BL1, BL2, BL3 and BL4 may not be perceived by the user. However, changing the boundary between the plurality of pixel blocks BL1, BL2, BL3 and BL4 may not be limited to the random setting described above. For example, in another exemplary embodiment of the inventive concept, the boundary between the plurality of pixel blocks BL1, BL2, BL3 and BL4 may be set regularly (e.g., by increasing two pixel rows per frame) within the boundary ranges BR1, BR2 and BR3.

As described above, the display device 100 according to an exemplary embodiment of the inventive concept may divide the display panel 110 into the plurality of pixel blocks BL1, BL2, BL3 and BL4, and may output the data voltage VD with the slew rate that increases as the distance from the data driver 130 increases to the plurality of pixel blocks BL1, BL2, BL3 and BL4. Accordingly, the plurality of pixel blocks BL1, BL2, BL3 and BL4 or the plurality of pixels PX1 to PXm may have a substantially uniform charging rate, and thus, the image quality of the display device 100 may be increased. Further, the display device 100 according to an exemplary embodiment of the inventive concept may change (or randomly set) the boundary between the plurality of pixel blocks BL1, BL2, BL3 and BL4 at which the slew rate is changed. Accordingly, the boundary between the plurality of pixel blocks BL1, BL2, BL3 and BL4 may not be perceived by the user, and thus, the image quality of the display device 100 may be further increased.

Figure 7:
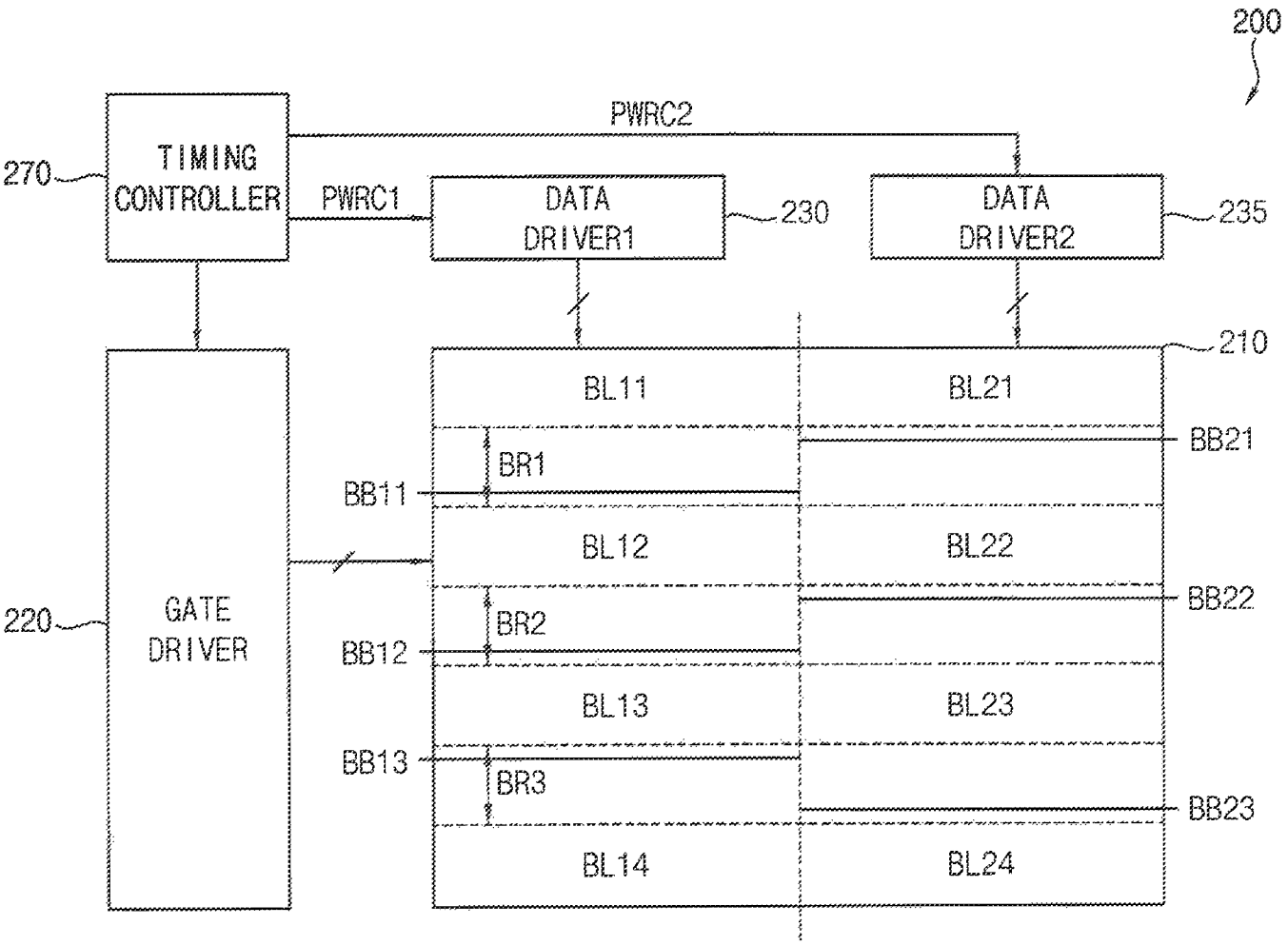
FIG. 7 is a block diagram illustrating a display device according to an exemplary embodiment of the inventive concept.

FIG. 7 is a block diagram illustrating a display device according to an exemplary embodiment of the inventive concept.

Referring to FIG. 7, a display device 200 may include a display panel 210 which includes a plurality of pixels, a gate driver 220 which provides a gate signal to the plurality of pixels, a plurality of data drivers 230 and 235 which provide a data voltage to the plurality of pixels, and a timing controller 270 which controls the gate driver 220 and the plurality of data drivers 230 and 235. The display device 200 of FIG. 7 may have a similar configuration and a similar operation to the display device 100 of FIG. 1, except that the display device 200 includes the first and second data drivers 230 and 235.

The first data driver 230 may output the data voltage to a first portion (e.g., a left half) of the display panel 210, and the second data driver 235 may output the data voltage to a second portion (e.g., a right half) of the display panel 210. In the display device 200 of FIG. 7 according to an exemplary embodiment of the inventive concept, the first data driver 230 may divide the first portion of the display panel 210 into a plurality of first pixel blocks BL11, BL12, BL13 and BL14, and may output the data voltage VD with different slew rates to the plurality of first pixel blocks BL11, BL12, BL13 and BL14 according to their distances from the first data driver 230. Further, the second data driver 235 may divide the second portion of the display panel 210 into a plurality of second pixel blocks BL21, BL22, BL23 and BL24, and may output the data voltage VD with different slew rates to the plurality of second pixel blocks BL21, BL22, BL23 and BL24 according to their distances from the second data driver 235.

At least one boundary BB11, BB12 and BB13 between the plurality of first pixel blocks BL11, BL12, BL13 and BL14 and at least one boundary BB21, BB22 and BB23 between the plurality of second pixel blocks BL21, BL22, BL23 and BL24 may be set independently of each other, and may be changed over time. For example, the boundaries BB11, BB12 and BB13 between the plurality of first pixel blocks BL11, BL12, BL13 and BL14 and the boundaries BB21, BB22 and BB23 between the plurality of second pixel blocks BL21, BL22, BL23 and BL24 may be changed periodically or on a per-frame basis. Accordingly, luminance differences at the boundaries BB11, BB12 and BB13 between the plurality of first pixel blocks BL11, BL12, BL13 and BL14 and at the boundaries BB21, BB22 and BB23 between the plurality of second pixel blocks BL21, BL22, BL23 and BL24 may be perceived by a user.

In an exemplary embodiment of the inventive concept, the boundaries BB11, BB12 and BB13 between the plurality of first pixel blocks BL11, BL12, BL13 and 13L14 may be randomly set within predetermined boundary ranges BR1, BR2 and BR3 (e.g., periodically or on the per-frame basis) by a first control signal PWRC1 provided to the first data driver 230 from the timing controller 270, and the boundaries BB21, BB22 and BB23 between the plurality of second pixel blocks BL21, BL22, BL23 and BL24 may be randomly set within the boundary ranges BR1, BR2 and BR3 (e.g., periodically or on the per-frame basis) by a second control signal PWRC2 provided to the second data driver 235 from the timing controller 270. Accordingly, since the boundaries BB11, BB12 and BB13 between the plurality of first pixel blocks BL11, BL12, BL13 and BL14 and the boundaries BB21, BB22 and BB23 between the plurality of second pixel blocks BL21, BL22, BL23 and BL24 are randomly set within the same boundary ranges BR1, BR2 and BR3 independently of each other, the luminance differences at the boundaries BB11, BB12, BB13, BB21, BB22 and BB23 may not be perceived by the user.

Figure 8:
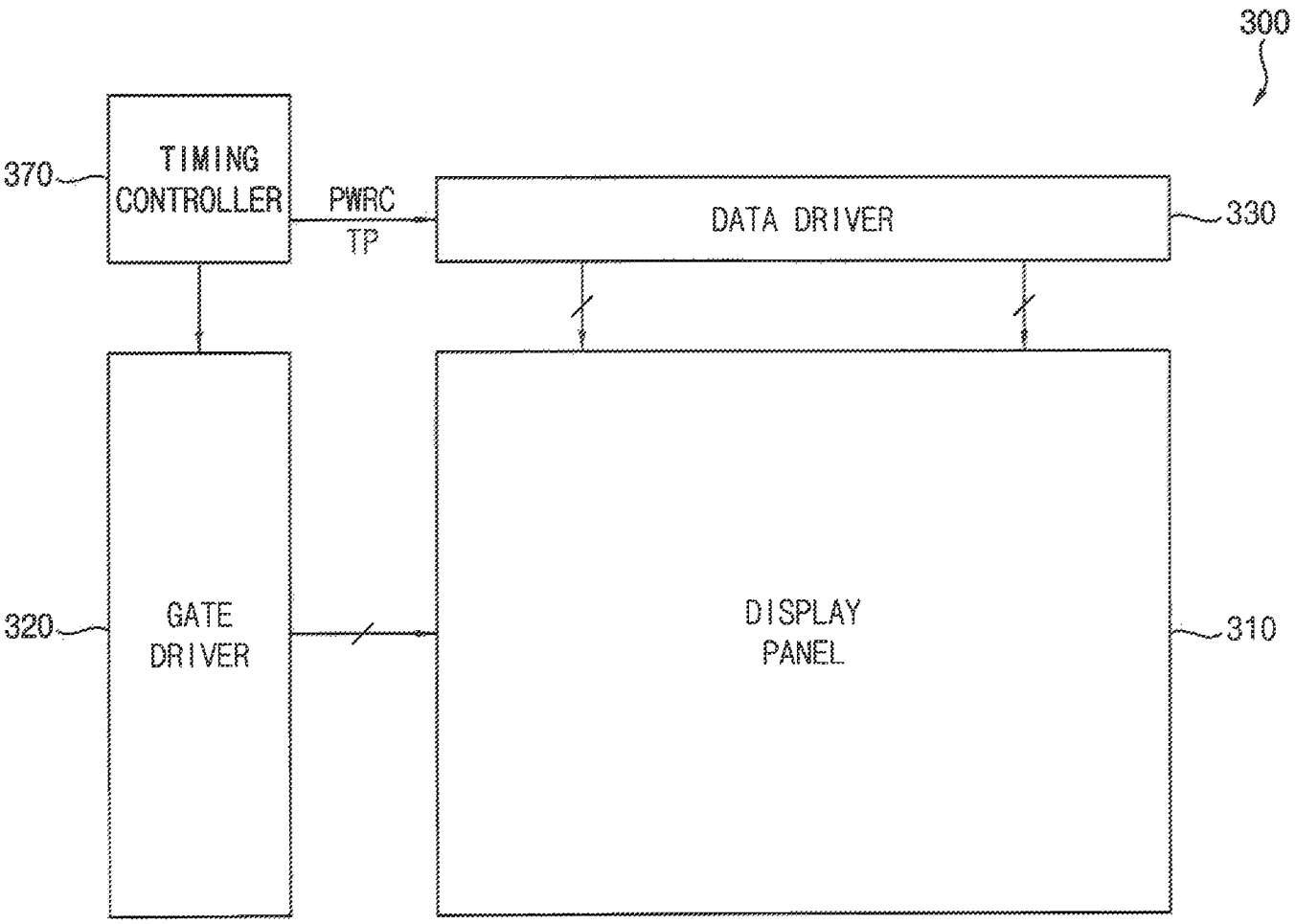
FIG. 8 is a block diagram illustrating a display device according to an exemplary embodiment of the inventive concept.
Figure 9:
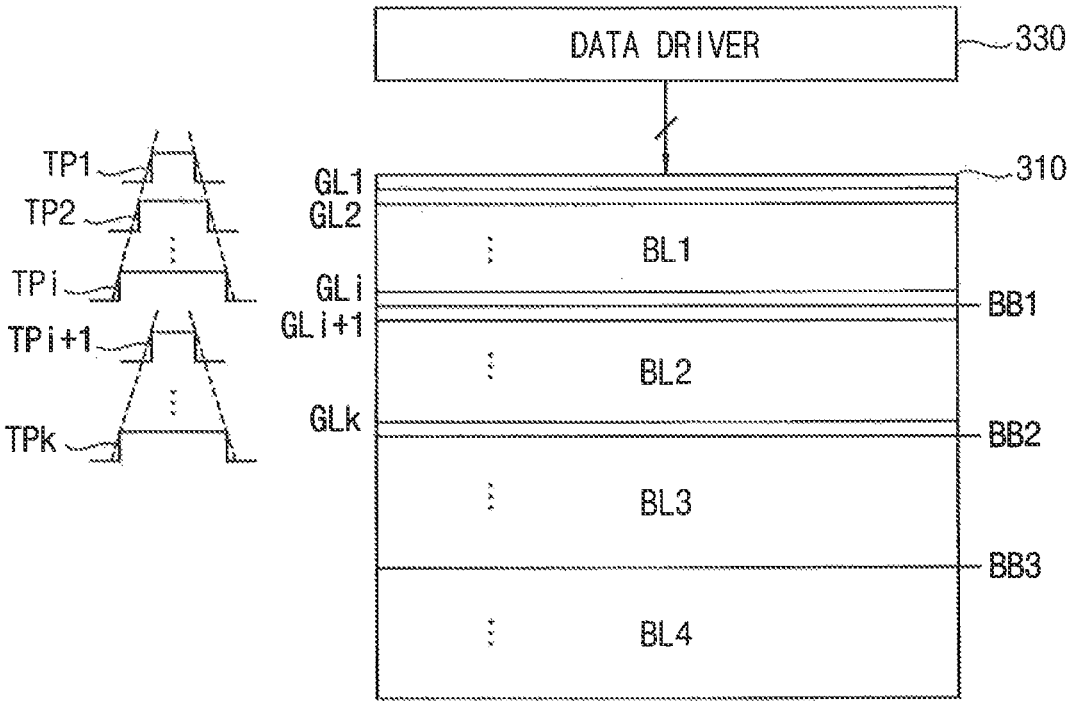
FIG. 9 is a diagram for describing a transfer pulse of which a pulse width is adjusted in a display device according to an exemplary embodiment of the inventive concept.

FIG. 8 is a block diagram illustrating a display device according to an exemplary embodiment of the inventive concept, and FIG. 9 is a diagram for describing a transfer pulse of which a pulse width is adjusted in a display device according to an exemplary embodiment of the inventive concept.

Referring to FIGS. 8 and 9, a display device 300 may include a display panel 310 which includes a plurality of pixels, a gate driver 320 which provides a gate signal to the plurality of pixels, a data driver 330 which provides a data voltage to the plurality of pixels, and a timing controller 370 which controls the gate driver 320 and the data driver 330. The display device 300 of FIG. 8 may have a similar configuration and a similar operation to the display device 100 of FIG. 1, except that the timing controller 370 further provides the data driver 330 with a transfer pulse TP of which a pulse width is adjusted.

The timing controller 370 may provide the data driver 330 with a control signal PWRC that sets different current setting values with respect to a plurality of pixel blocks BL1, BL2, BL3 and BL4 such that the data driver 300 may divide the display panel 310 into the plurality of pixel blocks BL1, BL2, BL3 and BL4 and may output the data voltage VD with different slew rates to the plurality of pixel blocks BL1, BL2, BL3 and BL4. Further, the timing controller 370 may generate the control signal PWRC such that at least one boundary BB1, BB2 and BB3 between the plurality of pixel blocks BL1, BL2, BL3 and BL4 is changed (or randomly set) (e.g., periodically or on a per-frame basis).

Further, the timing controller 370 may provide the data driver 330 with the transfer pulse TP for controlling an output timing of the data voltage VD, and may adjust a pulse width of the transfer pulse TP such that the transfer pulse TP may have different pulse widths according to distances of the plurality of pixels within each pixel block BL1, BL2, BL3 and BL4 from the data driver 330. For example, as illustrated in FIG. 9, in a case where a first pixel block BL1 includes first through i-th pixel rows respectively connected to first through i-th gate lines GL1, GL2 through GLi, where i is an integer greater than 1, when the data voltage VD is output to the first pixel row connected to the first gate line GL1, the timing controller 370 may provide the data driver 330 with a first transfer pulse TP1 having a relatively narrow first pulse width, and the data driver 330 may output the data voltage VD to the first pixel row in response to the first transfer pulse TP1. Further, when the data voltage VD is output to the second pixel row connected to the second gate line GL2, the timing controller 370 may provide the data driver 330 with a second transfer pulse TP2 having a second pulse width greater than the first pulse width, and the data driver 330 may output the data voltage VD to the second pixel row in response to the second transfer pulse TP2. Since the second transfer pulse TP2 has the second pulse width, which is increased compared with the first pulse width of the first transfer pulse TP1, a transition time of the data voltage VD output in response to the second transfer pulse TP2 may be slightly decreased. Thus, the transition time of the data voltage VD may be adjusted by using different bias currents with respect to the different pixel blocks BL1, BL2, BL3 and BL4, and the transition time of the data voltage VD may be further slightly adjusted by using the transfer pulses (e.g., TP1, TP2 and TPi) having different pulse widths with respect to different pixel rows within each pixel block (e.g., BL1). Similarly, until the data voltage VD is output to the i-th pixel row connected to the i-th gate line GLi, the pulse width of the transfer pulse TP1, TP2 and TPi may be gradually increased. Further, for example, a pulse width of a transfer pulse TPi+1 to TPk for (i+1)-th through k-th pixel rows respectively connected to (i+1)-th through k-th gate lines GLi+1 through GLk within a second pixel block BL2 may also be increased according to a distance from the data driver 330.

In an exemplary embodiment of the inventive concept, in a case where the display device 200 includes the first and second data drivers 230 and 235 as illustrated in FIG. 7, the timing controller 270 may provide first and second transfer pulses to the first second data drivers 230 and 235, respectively. The first transfer pulse may have a pulse width that gradually increases as distances of a plurality of pixels within each first pixel block (e.g., BL11) from the first data driver 230 increase, and the second transfer pulse may have a pulse width that gradually increases as distances of a plurality of pixels within each second pixel block (e.g., BL21) from the second data driver 235 increase.

Figure 10:
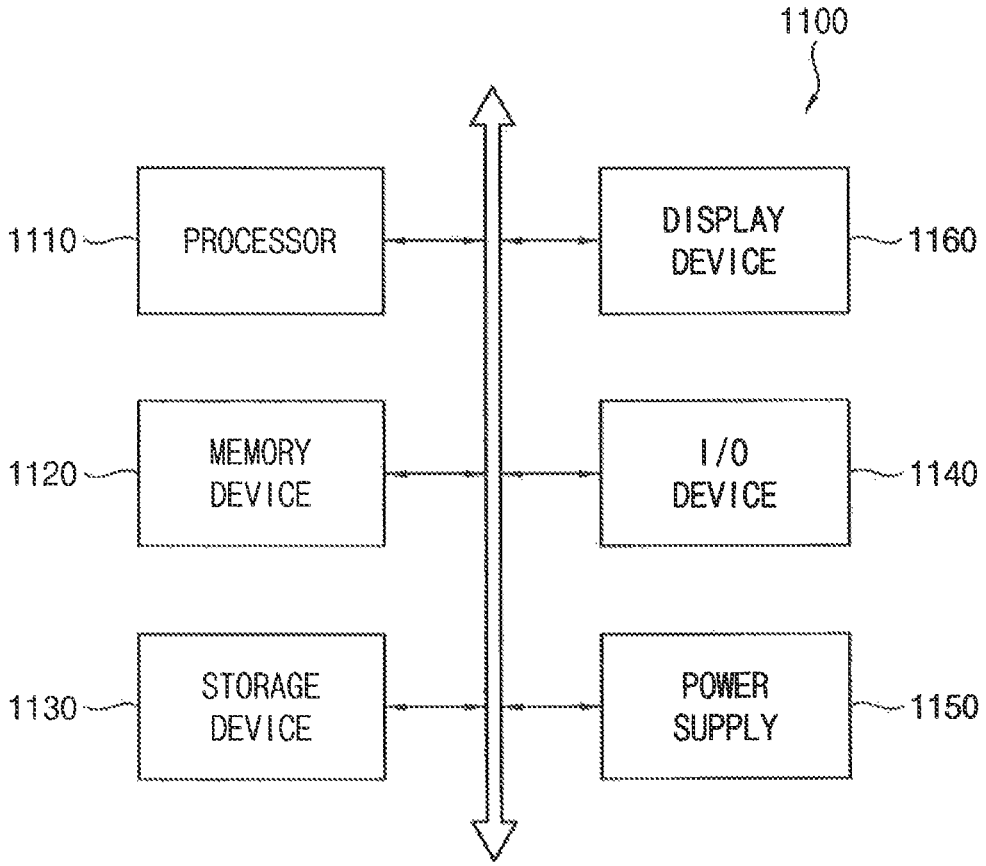
FIG. 10 is a block diagram illustrating an electronic device including a display device according to an exemplary embodiment of the inventive concept.

FIG. 10 is a block diagram illustrating an electronic device including a display device according to an exemplary embodiment of the inventive concept.

Referring to FIG. 10, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in an exemplary embodiment of the inventive concept, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a compact disc read only memory (CD-ROM) device, etc. The I/O device 1140 may be an input device such as a keyboard, a keypad, a mouse, a touch screen, etc., and an output device such as a printer, a speaker, etc. The power supply 1150 may supply power for operations of the electronic device 1100.

The display device 1160 may divide a display panel into a plurality of pixel blocks, may output a data voltage with a slew rate that increases as a distance from a data driver increases to the plurality of pixel blocks. Accordingly, the plurality of pixel blocks (or a plurality of pixels) may have a substantially uniform charging rate, and an image quality of the display device 1160 may be increased. Further, the display device 1160 may change (e.g., randomly set) a boundary between the plurality of pixel blocks at which the slew rate is changed. Accordingly, the boundary between the plurality of pixel blocks may not be perceived by a user, and the image quality of the display device 1160 may be further increased.

According to an exemplary embodiment of the inventive concept, the electronic device 1100 may be any electronic device including the display device 1160, such as a digital television, a three-dimensional (3D) television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display device, comprising:

a display panel including a plurality of pixels; and a data driver configured to arrange the display panel into a plurality of pixel blocks, and to output a data voltage with different slew rates to the plurality of pixel blocks, wherein the slew rates are based on distances of the plurality of pixel blocks from the data driver, wherein a boundary between adjacent pixel blocks with different slew rates is changeable, wherein the data driver further includes:

a plurality of output buffers configured to output the data voltage to a plurality of data lines;

a bias generator configured to provide a bias current to the plurality of output buffers, wherein the bias current is changed such that the plurality of output buffers output the data voltage with different slew rates to the plurality of pixel blocks; and a register configured to store a current setting value for setting a level of the bias current generated by the bias generator, wherein the register stores different current setting values for the plurality of pixel blocks and the bias current generator generates the bias current having a current level corresponding to one of the current setting values stored in the register, and wherein the current setting value of the register is set by a control signal provided from a timing controller that controls the data driver and a gate driver.

2. The display device of claim 1, wherein the boundary between the adjacent pixel blocks is periodically changed.

3. The display device of claim 1, wherein the boundary between the adjacent pixel blocks is changed on a per-frame basis.

4. The display device of claim 1, wherein the boundary between the adjacent pixel blocks is changed, when the boundary between the adjacent pixel blocks is randomly set within a predetermined boundary range.

5. The display device of claim 1, wherein the boundary between the adjacent pixel blocks is changed, when the boundary between the adjacent pixel blocks is randomly set within a predetermined boundary range on a per-frame basis.

6. The display device of claim 1, wherein the plurality of pixel blocks include a first pixel block and a second pixel block, wherein the first pixel block is closer to the data driver than the second pixel block, and wherein the data driver outputs the data voltage with a first slew rate to the first pixel block, and outputs the data voltage with a second slew rate higher than the first slew rate to the second pixel block.

7. The display device of claim 1, wherein when the data voltage is output to a pixel block close to the data driver among the plurality of pixel blocks, the bias generator provides a first bias current to the plurality of output buffers, and when the data voltage is output to a pixel block far from the data driver among the plurality of pixel blocks, the bias generator provides a second bias current to the plurality of output buffers, wherein the first bias current is lower than the second bias current.

8. The display device of claim 1, further comprising:

the timing controller configured to control the data driver and the gate driver, and to provide the data driver with a transfer pulse for controlling an output timing of the data voltage, wherein the transfer pulse has different pulse widths depending on distances of the plurality of pixels within each of the plurality of pixel blocks from the data driver.

9. The display device of claim 8, wherein, as the distances of the plurality of pixels within each of the plurality of pixel blocks from the data driver increase, the pulse width of the transfer pulse is increased.

10. A display device, comprising:

a display panel including a plurality of pixels; and a data driver configured to divide the display panel into a first pixel block and a second pixel block, wherein the first pixel block is closer to the data driver than the second pixel block, to output a data voltage with a first slew rate to the first pixel block, and to output the data voltage with a second slew rate higher than the first slew rate to the second pixel block, wherein a boundary between the first pixel block and the second pixel block is randomly set, wherein the data driver further includes:

a plurality of output buffers configured to output the data voltage to a plurality of data lines;

a bias generator configured to provide a bias current to the plurality of output buffers, wherein the bias current is changed such that the plurality of output buffers output the data voltage with different slew rates to the first and second pixel blocks; and a register configured to store a current setting value for setting a level of the bias current generated by the bias generator, wherein the register stores different current setting values for the first and second pixel blocks and the bias current generator generates the bias current having a current level corresponding to one of the current setting values stored in the register, and wherein the current setting value of the register is set by a control signal provided from a timing controller that controls the data driver and a gate driver.

11. The display device of claim 10, wherein the boundary between the first pixel block and the second pixel block is randomly set within a predetermined boundary range on a per-frame basis.

12. A display device, comprising:

a display panel including a plurality of pixels;

a first data driver configured to output a data voltage to a first portion of the display panel; and a second data driver configured to output the data voltage to a second portion of the display panel, wherein the first data driver divides the first portion of the display panel into a plurality of first pixel blocks, and outputs the data voltage with different slew rates to the plurality of first pixel blocks according to their distances from the first data driver, wherein the second data driver divides the second portion of the display panel into a plurality of second pixel blocks, and outputs the data voltage with different slew rates to the plurality of second pixel blocks according to their distances from the second data driver, and wherein a boundary between the plurality of first pixel blocks and a boundary between the plurality of second pixel blocks are set independently of each other, and are changeable, and wherein the first data driver includes a register storing different current setting values for the plurality of first pixel blocks, each of the current setting values having a plurality of bits and being set by a timing controller that controls the first data driver, the second data driver and a gate driver.

13. The display device of claim 12, wherein the boundary between the plurality of first pixel blocks and the boundary between the plurality of second pixel blocks are periodically changed.

14. The display device of claim 12, wherein the boundary between the plurality of first pixel blocks and the boundary between the plurality of second pixel blocks are changed on a per-frame basis.

15. The display device of claim 12, wherein the boundary between the plurality of first pixel blocks is randomly set within a predetermined boundary range, and wherein the boundary between the plurality of second pixel blocks is randomly set within the predetermined boundary range.

16. The display device of claim 12, wherein the boundary between the plurality of first pixel blocks is randomly set within a predetermined boundary range on a per-frame basis, and wherein the boundary between the plurality of second pixel blocks is randomly set within the predetermined boundary range on the per-frame basis.

17. The display device of claim 12, further comprising:

the timing controller configured to control the first data driver, the second data driver and the gate driver, to provide a first transfer pulse to the first data driver, and to provide a second transfer pulse to the second data driver, wherein a pulse width of the first transfer pulse is increased as distances of the plurality of pixels within each of the plurality of first pixel blocks from the first data driver increase, and wherein a pulse width of the second transfer pulse is increased as distances of the plurality of pixels within each of the plurality of second pixel blocks from the second data driver increase.

* * * * *